US010950957B2

(12) United States Patent
Chin

(10) Patent No.: US 10,950,957 B2
(45) Date of Patent: Mar. 16, 2021

(54) MALE PLUG, FEMALE SOCKET AND CONNECTOR

(71) Applicant: DONGGUAN SHUN WEI ELECTRONICS INDUSTRY CO LTD, GuangDong Province (CN)

(72) Inventor: Hsu-Shen Chin, GuangDong Province (CN)

(73) Assignee: DONGGUAN SHUN WEI ELECTRONICS INDUSTRY CO., LTD., Dongguan (CN)

( * ) Notice: Subject to any disclaimer, the term of this patent is extended or adjusted under 35 U.S.C. 154(b) by 0 days.

(21) Appl. No.: 16/220,747

(22) Filed: Dec. 14, 2018

(65) Prior Publication Data

US 2019/0199020 A1 Jun. 27, 2019

(30) Foreign Application Priority Data

Dec. 26, 2017 (CN) ..... 201721871359.1

(51) Int. Cl.

| | |
|---|---|
| ***H01R 12/00*** | (2006.01) |
| ***H01R 12/55*** | (2011.01) |
| ***H01R 13/502*** | (2006.01) |
| ***H01R 13/05*** | (2006.01) |
| ***H01R 13/62*** | (2006.01) |
| ***H01R 13/64*** | (2006.01) |
| ***H01R 13/42*** | (2006.01) |
| *H01R 107/00* | (2006.01) |
| *H01R 12/57* | (2011.01) |

(52) U.S. Cl.

CPC ..... *H01R 12/55* (2013.01); *H01R 13/055* (2013.01); *H01R 13/42* (2013.01); *H01R 13/502* (2013.01); *H01R 13/62* (2013.01); *H01R 13/64* (2013.01); *H01R 12/57* (2013.01); *H01R 2107/00* (2013.01)

(58) Field of Classification Search

CPC ... H01R 9/096; H01R 23/7073; H01R 13/113
USPC ..... 439/65, 79, 856, 660, 947
See application file for complete search history.

(56) References Cited

U.S. PATENT DOCUMENTS 3,621,444 A * 11/1971 Stein ..... H05K 7/1038 439/109
7,303,401 B2 * 12/2007 Schell ..... H01R 12/7088 439/65

(Continued)

*Primary Examiner* — Phuong Chi Thi Nguyen
(74) *Attorney, Agent, or Firm* — Muncy, Geissler, Olds & Lowe, P.C.

(57) ABSTRACT

A connector includes a male plug and a female socket. The male plug includes a plurality of terminals and a first insulation body. Each of the terminals includes a signal contact portion, a U-shaped terminal fixing portion, and a terminal soldering portion. The U-shaped terminal fixing portion of each of the terminals connects the signal contact portion and the terminal soldering portion. The first insulation body includes a plurality of connection slots, and each of the connection slots is configured to receive the terminal correspondingly. The female socket includes terminal portions, and a second insulation body having a plurality of receiving slots. Each of the receiving slots is configured to receive the terminal portion correspondingly. When the male plug is plugged into the female socket, the plurality of terminal portions are held by the signal contact portions of the male plug.

9 Claims, 7 Drawing Sheets

(56) References Cited

U.S. PATENT DOCUMENTS 7,476,110 B2 * 1/2009 Lemke ..... H01R 43/20
439/83
8,197,262 B2 * 6/2012 Nguyen ..... H01R 12/57
439/74

* cited by examiner

MALE PLUG, FEMALE SOCKET AND CONNECTOR

BACKGROUND

1. Field of the Invention

The present disclosure relates to a connector, more particularly, to a connector having enhanced terminal connection and signal transmission.

2. Description of the Related Art

With the advancement of science and technology, various kinds of electronic devices have been devised and the demand for connectors has also increased. The common practice of connectors utilizes the elastic pieces of the male plug that swing up and down to horizontally join the terminals of the female socket on top of the terminals. However, this kind of elastic pieces, after being plugged and unplugged frequently or being exerted with an excessive force, fracture or elastically fatigue, and finally lose their fixing effect. In addition, a traditional soft-wire connector structure is only fixed by using a fitting joint, which easily leads to unsecured joining or up-and-down or left-and-right shaking to affect the joining, and in turn causes electrical contact failure. It will also be affected by external noise interference to impact signal transmission quality. As a result, there is a need to improve the connector assembly structure so as to achieve more stable signal transmission and prolong service life.

SUMMARY

An objective of the present disclosure is to provide a connector having enhanced terminal connection and signal transmission.

In a first aspect of the present disclosure, a male plug of a connector is provided. The male plug is assembled to a female socket. The male plug includes a plurality of terminals and a first insulation body. Each of the terminals comprises a signal contact portion, a U-shaped terminal fixing portion, and a terminal soldering portion. The signal contact portion is configured to hold a terminal portion of the female socket correspondingly when the male plug is inserted into the female socket. The U-shaped terminal fixing portion of each of the terminals connects the signal contact portion and the terminal soldering portion. The first insulation body has a plurality of connection slots. Each of the connection slots is configured to receive the terminal correspondingly.

According to an embodiment of the present disclosure, the terminals comprise a ground terminal, a power terminal, and a signal terminal. The ground terminal is configured to transmit a ground voltage. The power terminal is configured to transmit a power voltage. The signal terminal is configured to transmit a data signal.

According to an embodiment of the present disclosure, the male plug further comprises a first housing that encapsulates the first insulation body. The first housing comprises a fitting portion configured to receive a protrusion portion of the female socket correspondingly when the male plug is assembled to the female socket.

According to an embodiment of the present disclosure, the signal contact portion is a pair of elastic pieces.

In a second aspect of the present disclosure, a female socket of a connector is provided. The female socket is assembled to a male plug. The female socket comprises a plurality of terminal portions and a second insulation body having a plurality of receiving slots. The terminal portions are configured to be held by signal contact portions of the male plug when the female socket is assembled to the male plug, lengths of the plurality of terminal portions being different. Each of the receiving slots is configured to receive the terminal portion correspondingly.

According to an embodiment of the present disclosure, the terminal portions comprise a ground terminal portion, a power terminal portion, and a signal terminal portion. The ground terminal portion is configured to transmit a ground voltage. The power terminal portion is configured to transmit a power voltage. The signal terminal portion is configured to transmit a data signal.

According to an embodiment of the present disclosure, a length of the ground terminal portion is greater than a length of the power terminal portion, the length of the power terminal portion is greater than a length of the signal terminal portion.

According to an embodiment of the present disclosure, the female socket further comprises a second housing, the second housing is engaged with the second insulation body. The second housing comprises a protrusion portion configured to be engaged with a fitting portion of the male plug when the male plug is assembled to the female socket.

In a third aspect of the present disclosure, the present disclosure provides a connector. The connector comprises a male plug and a female socket. The male plug comprises a plurality of terminals and a first insulation body. Each of the terminals comprises a signal contact portion, a U-shaped terminal fixing portion, and a terminal soldering portion. The U-shaped terminal fixing portion of each of the terminals connects the signal contact portion and the terminal soldering portion. The first insulation body has a plurality of connection slots. Each of the connection slots is configured to receive the terminal correspondingly. The female socket comprises a plurality of terminal portions and a second insulation body. The second insulation body has a plurality of receiving slots. Each of the receiving slots is configured to receive the terminal portion correspondingly. When the male plug is plugged into the female socket, the plurality of terminal portions are held by the signal contact portions of the male plug.

According to an embodiment of the present disclosure, the plurality of terminals comprise a ground terminal, a power terminal, and a signal terminal, the plurality of terminal portions comprise a ground terminal portion, a power terminal portion, and a signal terminal portion, the ground terminal portion and the ground terminal are configured to transmit a ground voltage, the power terminal portion and the power terminal are configured to transmit a power voltage, the signal terminal portion and the signal terminal are configured to transmit a data signal.

According to an embodiment of the present disclosure, a length of the ground terminal portion is greater than a length of the power terminal portion, the length of the power terminal portion is greater than a length of the signal terminal portion.

According to an embodiment of the present disclosure, the male plug further comprises a first housing, the first housing encapsulates the first insulation body, the first housing comprises a fitting portion, the female socket further comprises a second housing, the second housing is engaged with the second insulation body, the second housing comprises a protrusion portion configured to be engaged with the fitting portion of the male plug when the male plug is assembled to the female socket.

According to an embodiment of the present disclosure, the terminal portion comprises a terminal contact portion, a terminal fixing portion, and a terminal contour portion, an angle is formed between the terminal soldering portion and the terminal contact portion, the angle is from 80 to 90 degrees.

As compared with the related art, the connector according to the present disclosure has a male plug and a female socket. The plurality of terminals of the male plug contact the terminal portions of the female socket correspondingly. In addition, the signal contact portion of the terminal holds two sides of the terminal portion through a pair of elastic pieces. Hence, a better elastic performance and fixing effect are obtained. The service life is extended. As a result, the present disclosure improves the signal transmission quality and stability of the connector.

These and other objectives of the claimed invention will no doubt become obvious to those of ordinary skill in the art after reading the following detailed description of the embodiment that is illustrated in the various figures and drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

For better understanding embodiments of the present disclosure, the following detailed description taken in conjunction with the accompanying drawings is provided.

Apparently, the accompanying drawings are merely for some of the embodiments of the present disclosure. Any ordinarily skilled person in the technical field of the present disclosure could still obtain other accompanying drawings without use laborious invention based on the present accompanying drawings.

The following descriptions of all embodiments, with reference to the accompanying drawings, are used to exemplify the present disclosure. Directional terms mentioned in the present disclosure, such as "top", "bottom", "front", "back", "left", "right", "inside", "outside", "side", etc., are only used with reference to the orientation of the accompanying drawings. Therefore, the used directional terms are intended to illustrate, but not to limit, the present disclosure.

Figure 1:
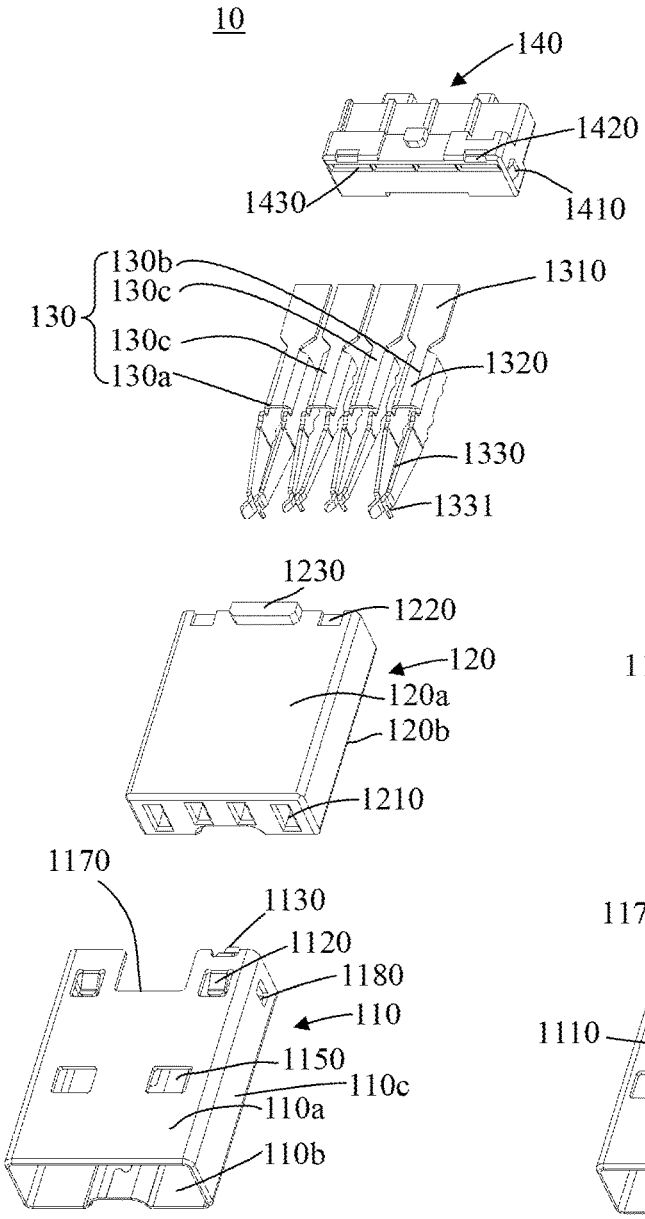
FIG. 1 and FIG. 2 are exploded views of a male plug of a connector viewed from two opposite viewing angles according to a preferred embodiment of the present disclosure.
Figure 2:
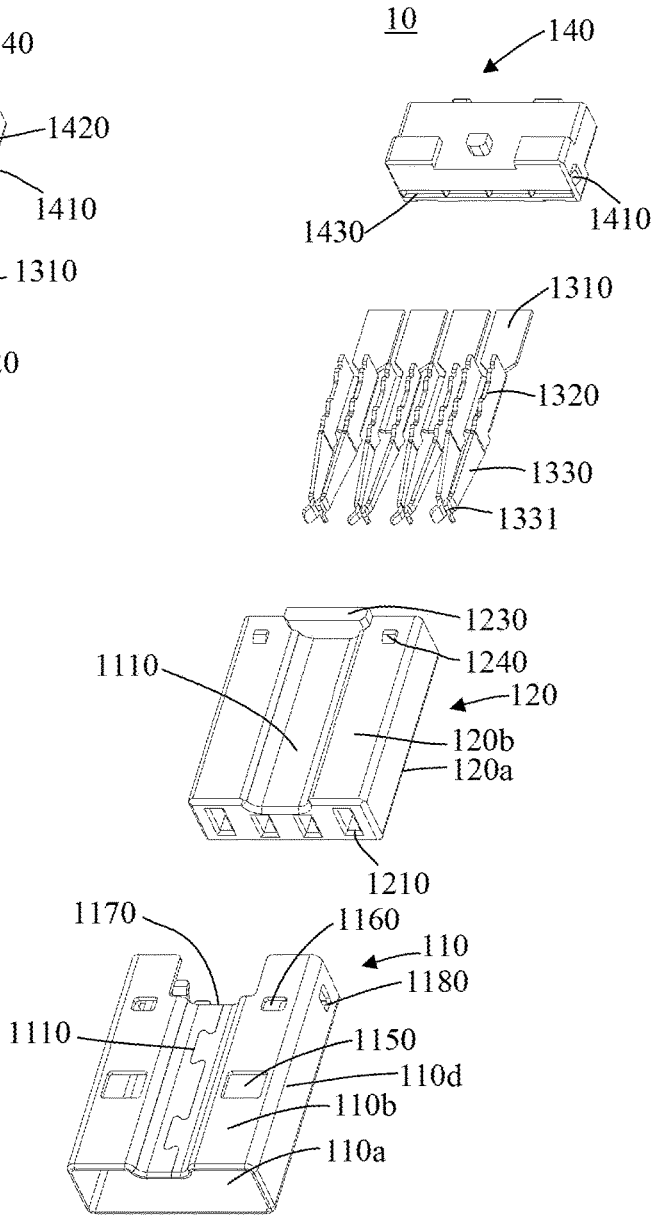

A description is provided with reference to FIG. 1 and FIG. 2. FIG. 1 and FIG. 2 are exploded views of a male plug 10 of a connector 30 viewed from two opposite viewing angles according to a preferred embodiment of the present disclosure. To simplify matters, the viewing angles of FIG. 1 and FIG. 2 differ by 180 degrees (a direction perpendicular to the horizontal plane is taken as a basis). The male plug 10 and a female socket 20 (depicted in FIG. 8 and FIG. 9), after being assembled, can form the connector 30 (depicted in FIG. 15 to FIG. 19). The male plug 10 comprises a first housing 110, a first insulation body 120, a plurality of terminals 130 and a rear plug 140.

The first housing 110 comprises a fitting portion 1110, and its function is described in detail later. The first housing 110 encapsulates the first insulation body 120. The plurality of terminals 130 are fixed in the first insulation body 120 and the rear plug 140. The first insulation body 120 comprises a plurality of connection slots 1210. The connection slots 1210 are located at the first insulation body 120. The connection slots 1210 are channels for connecting the terminals 130.

The terminals 130 comprise a power terminal 130*a*, a ground terminal 130*b*, and signal terminals 130*c* located between the power terminal 130*a* and the ground terminal 130*b*. The power terminal 130*a* transmits a power signal. The ground terminal 130*b* transmits a ground signal. The signal terminals 130*c* transmit data signals. According to the present embodiment, the signal terminals 130*c* may be configured to transmit data signals in a differential mode. Each of the terminals 130 comprises a terminal soldering portion 1310, a terminal fixing portion 1320, and a signal contact portion 1330. The terminal fixing portion 1320 is connected between the signal contact portion 1330 and the terminal soldering portion 1310. The terminal soldering portion 1310 is a flat plate for passing through a through slot 1430 of the rear plug 140 and then being placed on the rear plug 140. Preferably, a size of the through slot 1430 substantially conforms to a thickness and a width of the terminal soldering portion 1310. The terminal fixing portion 1320 is an elastic structure and is in a U shape. When the terminal 130 passes through the connection slot 1210 of the first insulation body 120, the terminal fixing portion 1320 is pressed by a sidewall of the connection slot 1210 so that the terminal 130 is fixed in the first insulation body 120. The signal contact portion 1330 is a pair of elastic pieces 1331 extending from the terminal fixing portion 1320.

The first housing 110 comprises a first surface 110*a*, a second surface 110*b*, a third surface 110*c*, and a fourth surface 110*d*. The second surface 110*b* is located on a side of the first housing 110 opposite to the first surface 110*a*. The third surface 110*c* and the fourth surface 110*d* are perpendicular to the first face 110*a* and the second face 110*b*, respectively. The first surface 110*a* comprises a ground soldering portion 1130, first fixing elastic pieces 1120, first positioning holes 1150, and a first positioning slot 1170. The second surface 110*b* comprises the fitting portion 1110, the first positioning holes 1150, and second positioning holes 1160. Each of the third surface 110*c* and the fourth surface 110*d* comprises a third positioning hole 1180. First positioning slots 1220 and a first positioning protrusion 1230 are located on a first surface 120*a*. The first positioning protrusion 1230 and protrusions 1240 are located on a second surface 120*b*.

Figure 3:
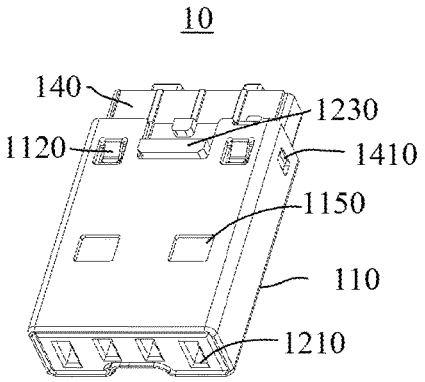
FIG. 3 and FIG. 4 are structural diagrams of the assembled male plug respectively viewed from two opposite viewing angles.
Figure 4:
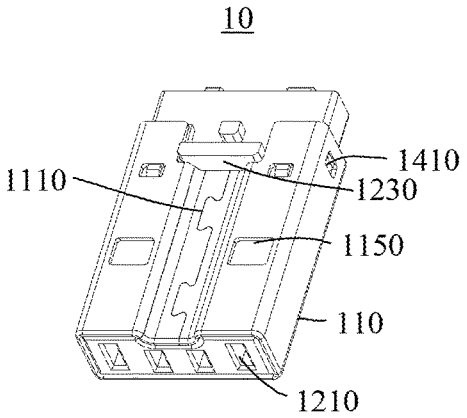

A description is provided with reference to FIG. 1 to FIG. 4. FIG. 3 and FIG. 4 are structural diagrams of the assembled male plug respectively viewed from two opposite viewing angles. It is noted that, to simplify matters, the viewing angles of FIG. 3 and FIG. 4 differ by 180 degrees (a direction perpendicular to the horizontal plane is taken as a basis). The first positioning protrusion 1230 of the first insulation body 120 is aligned with the first positioning slot 1170 of the first surface 110*a* of the first housing 110 and is engaged with the first housing 110. The first fixing elastic pieces 1120 of the first surface 110*a* of the first housing 110 are engaged with the first positioning slots 1220 of the first insulation body 120 and fix the first insulation body 120. The protrusions 1240 of the first insulation body 120 are engaged with the second positioning holes 1160 of the second surface 110*b* of the first housing 110 and fix the first insulation body 120.

The rear plug 140 comprises a second positioning protrusion 1410. The second positioning protrusion 1410 of the rear plug 140 is aligned with the third positioning hole 1180 of the first housing 110 and engaged with the first housing 110. At the same time, the rear plug 140 is fixed.

Figure 5:
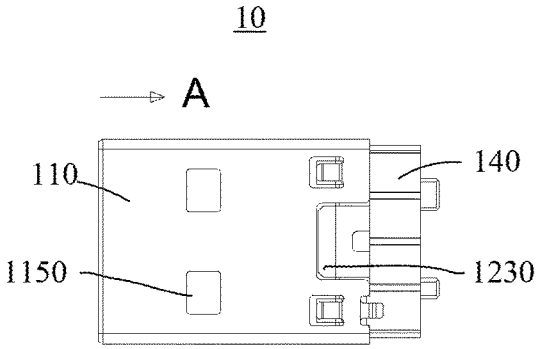
FIG. 5 is a top view of the male plug in FIG. 3.
Figure 6:
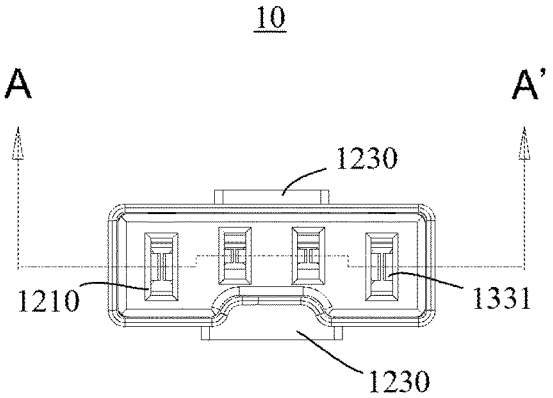
FIG. 6 is a side view viewed along direction A of FIG. 5.
Figure 7:
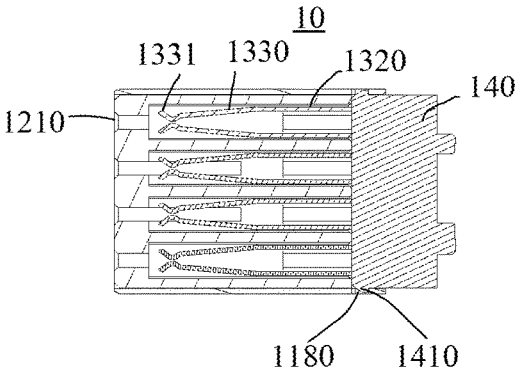
FIG. 7 is a cross-sectional view taken along line A-A' of FIG. 6.

A description is provided with reference to FIG. 5 to FIG. 7. FIG. 5 is a top view of the male plug 10 in FIG. 3. FIG. 6 is a side view viewed along direction A of FIG. 5. FIG. 7 is a cross-sectional view taken along line A-A' of FIG. 6. The elastic pieces 1331 of the signal contact portions 1330 of the terminals 130 are aligned with the connection slots 1210 of the first insulation body 120. The elastic pieces 1331 are arranged in pairs, and openings of the pairs of elastic pieces face the connecting slots 1210 of the first insulation body 120. The rear plug 140 is approached the terminal fixing portions 1320 and is fixed in the first housing 110. The connection slots 1210 located at outermost positions, that is, located at left and right ends, are on a different horizontal plane from the connection slots 1210 located at inner positions.

Figure 8:
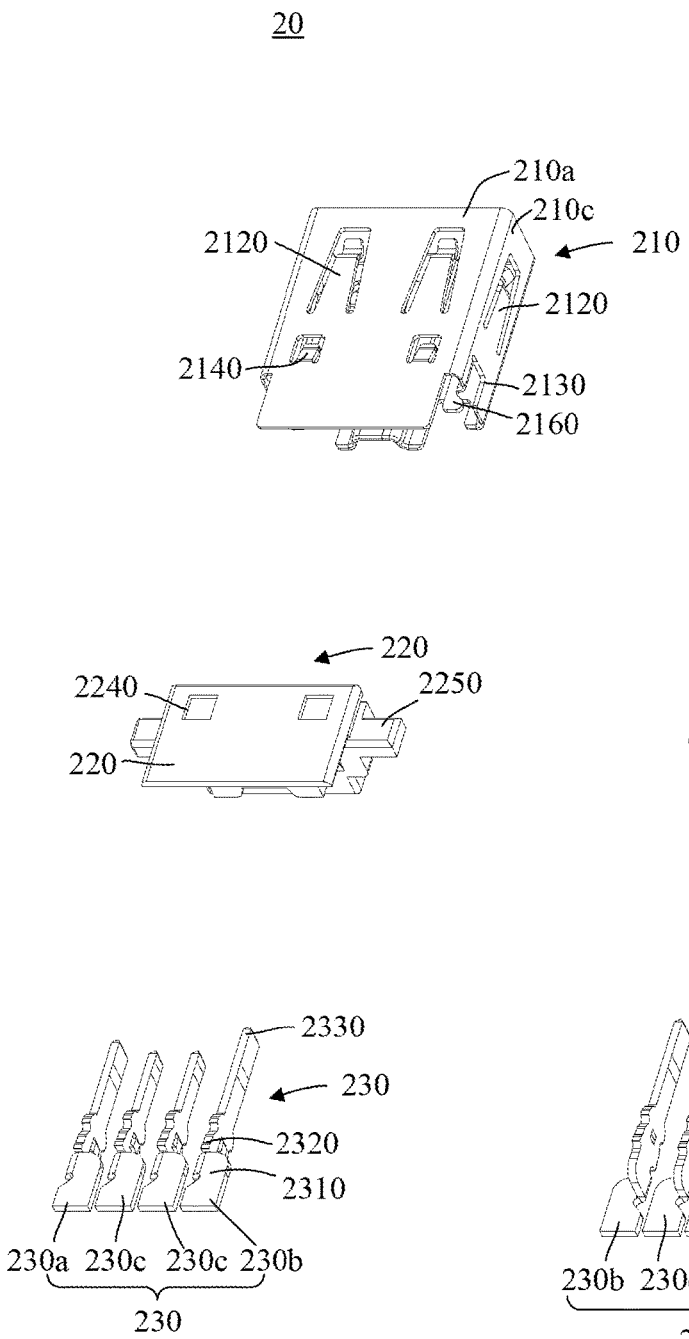
FIG. 8 and FIG. 9 are exploded views of the female socket viewed from two opposite viewing angles according to a preferred embodiment of the present disclosure.
Figure 9:
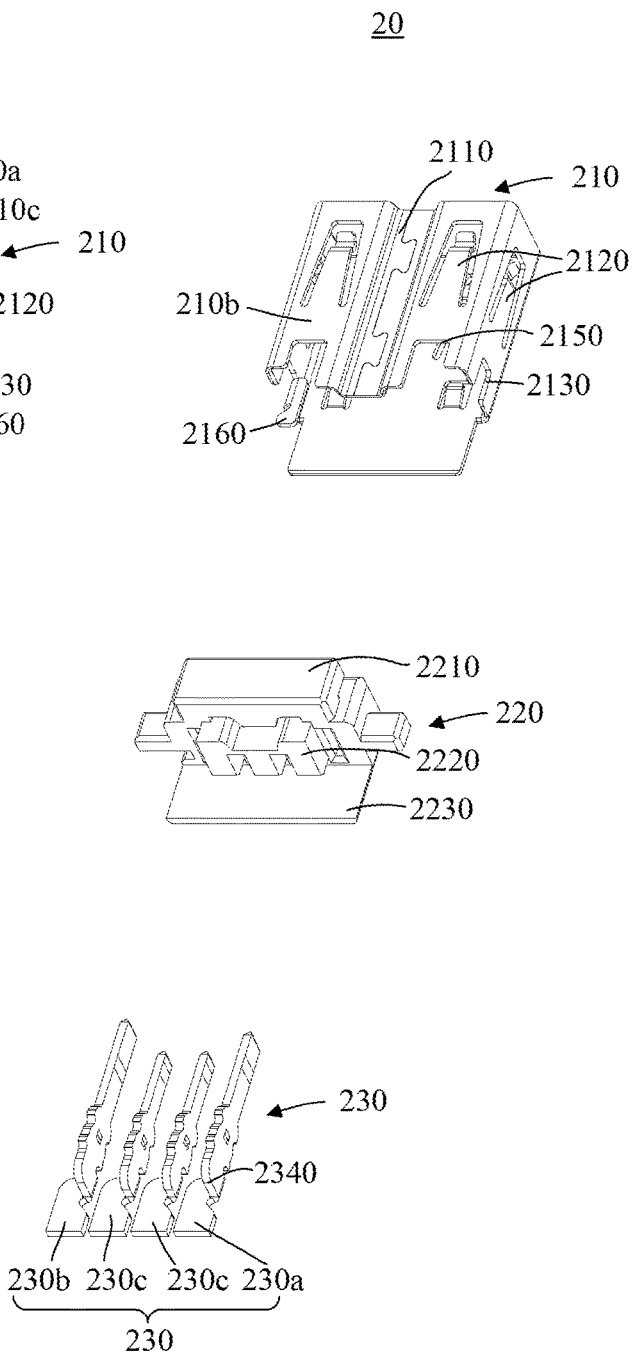

A description is provided with reference to FIG. 8 and FIG. 9. FIG. 8 and FIG. 9 are exploded views of the female socket 20 viewed from two opposite viewing angles according to a preferred embodiment of the present disclosure. To simplify matters, the viewing angles of FIG. 8 and FIG. 9 differ by 180 degrees (a direction perpendicular to the horizontal plane is taken as a basis). The female socket 20 comprises a housing 210, a protrusion portion 2110, a second insulation body 220 and a plurality of terminal portions 230. The housing 210 comprises the protrusion portion 2110 configured to abut the fitting portion 1110 of the corresponding male plug 10 so as to prevent incorrect insertion when connecting the male plug 10. The housing 210 encapsulates the second insulation body 220. The plurality of terminal portions 230 are fixed to the second insulation body 220. The second insulation body 220 comprises a fixing portion 2210, a spacing portion 2220 and a supporting portion 2230. The fixing portion 2210 is engaged with a device (not shown in the figure). The spacing portion 2220 is located between terminal contour portions 2340. The supporting portion 2230 supports terminal soldering portions 2310. One part of the housing 210 passes through the second insulation body 220 and extends to the terminal contour portions 2340. One part of the housing 210 extends to the supporting portion 2230.

Each of the terminal portions 230 comprises the terminal soldering portion 2310, a terminal fixing portion 2320, and a terminal contact portion 2330. The terminal portions 230 comprise a power terminal portion 230*a*, a ground terminal portion 230*b* and signal terminal portions 230*c* located between the power terminal portion 230*a* and the ground terminal portion 230*b*. The power terminal portion 230*a* transmits the power signal. The ground terminal portion 230*b* transmits the ground signal. The signal terminal portions 130*c* transmit the data signals. The terminal soldering portion 2310, the terminal fixing portion 2320, and the terminal contact portion 2330 are integrally formed. Positions of the signal terminal portions 230*c* located near the protrusion portion 2110 are slightly lower than a horizontal plane where the outermost power terminal portion 230*a* and ground terminal portion 230*b*, that is, the terminals located at left and right ends, are located. Preferably, the power terminal portion 230*a* and the ground terminal portion 230*b* are located at outermost positions, that is, positions at left and right ends. The signal terminal portions 230*c* are arranged between the power terminal portion 230*a* and the ground terminal portion 230*b*. The power terminal portion 230*a*, the ground terminal portion 230*b*, and the signal terminal portions 230*c* respectively connect the power terminal 130*a*, the ground terminal 130*b*, and the signal terminals 130*c* shown in FIG. 1. In addition, the housing 210 is disposed with a ground soldering portion 2160 on a ground terminal soldering portion 2310*b* for electrically connecting a grounding wire (not shown in the figure) of a device.

A description is provided with reference to FIG. 1, FIG. 2, FIG. 8 and FIG. 9. The terminal fixing portions 2320 are engaged with the second insulation body 220 so as to fix the terminal portions 230 in the second insulation body 220. The terminal contact portion 2330 of the terminal portion 230 is an elongated structure and can be inserted into a pair of elastic pieces 1331 of the corresponding male plug 10 and fixed to the terminal 130 of the corresponding male plug 10. The pair of elastic pieces 1331 are configured to align with one end of the terminal portion 230 of the corresponding female socket 20 and fix the terminal portion 230. In a connection state, the terminal contact portions 2330 of the terminal portions 230 of the female socket 20 pass through the connection slots 1210 of the male plug 10 and are inserted and held in the elastic pieces 1331 of the signal contact portions 1330 of the male plug 10. When the power terminal portion 230*a*, the ground terminal portion 230*b*, and the signal terminal portions 230*c* are respectively connected to the power terminal 130*a*, the ground terminal 130*b*, and the signal terminals 130*c*, they can be respectively used for transmitting the power signal, the ground signal, and the data signals. A length of the ground terminal portion 230*b* is greater than a length of the power terminal portion

230*a*, and the length of the power terminal portion 230*a* is greater than a length of the signal terminal portions 230*c*. Preferably, a length of the terminal contact portion 2330 of the ground terminal portion 230*b* is greater than a length of the terminal contact portion 2330 of the power terminal portion 230*a*. The length of the terminal contact portion 2330 of the power terminal portion 230*a* is greater than a length of the terminal contact portions 2330 of the signal terminal portions 230*c*.

Figure 10:
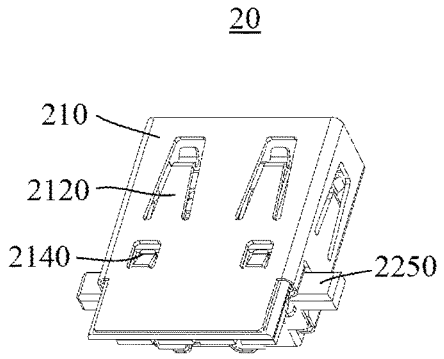
FIG. 10 and FIG. 11 are structural diagrams of the assembled female socket respectively viewed from two opposite viewing angles.
Figure 11:
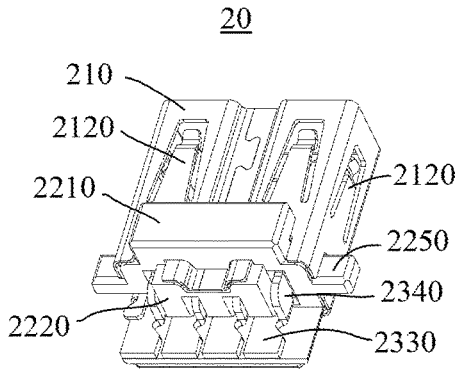

A description is provided with reference to FIG. 10 and FIG. 11. FIG. 10 and FIG. 11 are structural diagrams of the assembled female socket respectively viewed from two opposite viewing angles. It is noted that, to simplify matters, the viewing angles of FIG. 10 and FIG. 11 differ by 180 degrees (a direction perpendicular to the horizontal plane is taken as a basis). The housing 210 comprises a first surface 210*a*, a second surface 210*b*, and third surfaces 210*c*. The second surface 210*b* is located on a side of the housing 210 opposite to the first surface 210*a*. The third surfaces 210*c* are located on sides of the housing 210 adjacent to the first surface 210*a*. The first surface 210*a* comprises second fixing elastic pieces 2140, and a third fixing elastic piece 2120. The second surface 210*b* comprises the protrusion portion 2110, the third fixing elastic pieces 2120, and a second positioning slot 2150. Each of the third surfaces 210*c* comprises the third fixing elastic piece 2120 and a third positioning slot 2130. One of the third surfaces 210*c* comprises the ground soldering portion 2160.

The second insulation body 220 comprises second positioning holes 2240. The fixing portion 2210 of the second insulation body 220 comprises tenons 2250. The tenons 2250 of the second insulation body 220 are aligned with the third positioning slots 2130 of the third surfaces 210*c* and engaged with the housing 210. The second fixing elastic pieces 2140 of the first surface 210*a* of the housing are engaged with the second positioning holes 2240 of the second insulation body 220 and fix the second insulation body 220. The third fixing elastic pieces 2120 of the first surface 210*a* of the housing 210 are engaged with the first positioning holes 1150 of the corresponding male plug 10 and fix the female socket 20 and male plug 10.

Figure 12:
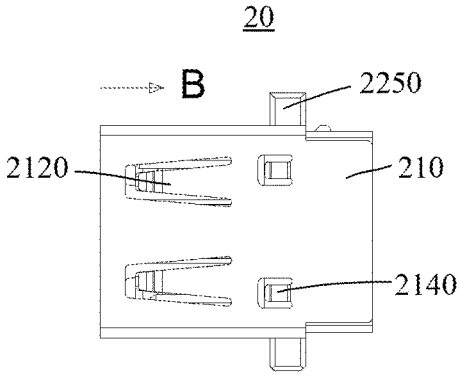
FIG. 12 is a top view of the female socket in FIG. 10.
Figure 13:
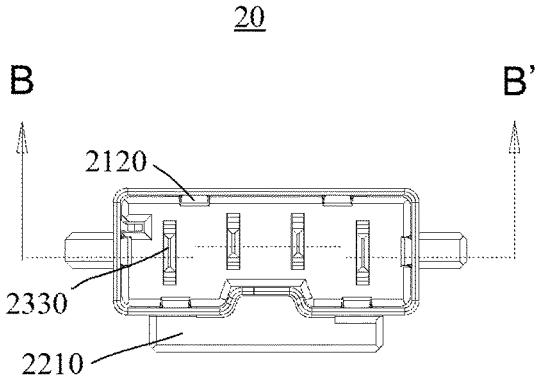
FIG. 13 is a side view viewed along direction B of FIG. 12.
Figure 14:
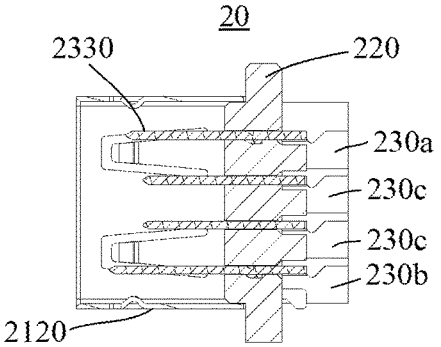
FIG. 14 is a cross-sectional view taken along line B-B' of FIG. 12.

A description is provided with reference to FIG. 12 to FIG. 14. FIG. 12 is a top view of the female socket in FIG. 10. FIG. 13 is a side view viewed along direction B of FIG. 12. FIG. 14 is a cross-sectional view taken along line B-B' of FIG. 12. The terminal portions 230 have different lengths. Preferably, a length of the ground terminal portion 230*b* is greater than a length of the power terminal portion 230*a*. The length of the power terminal portion 230*a* is greater than a length of the signal terminal portions 230*c*.

Figure 15:
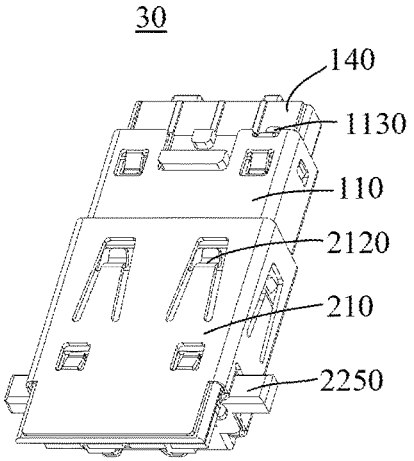
FIG. 15 and FIG. 16 are structural diagrams of an assembled connector respectively viewed from two opposite viewing angles according to another embodiment of the present disclosure.
Figure 16:
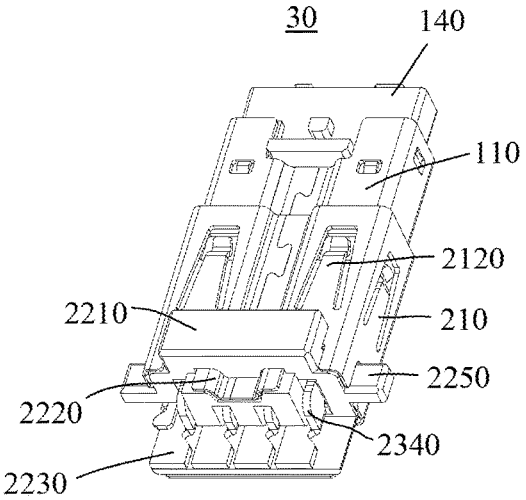

A description is provided with reference to FIG. 15 and FIG. 16. FIG. 15 and FIG. 16 are structural diagrams of an assembled connector respectively viewed from two opposite viewing angles according to another embodiment of the present disclosure. It is noted that, to simplify matters, the viewing angles of FIG. 15 and FIG. 16 differ by 180 degrees (a direction perpendicular to the horizontal plane is taken as a basis). The third fixing elastic pieces 2120 of the female socket 20 are engaged with the first positioning holes 1150 of the corresponding male plug 10 and fix the female socket 20 and male plug 10.

Figure 17:
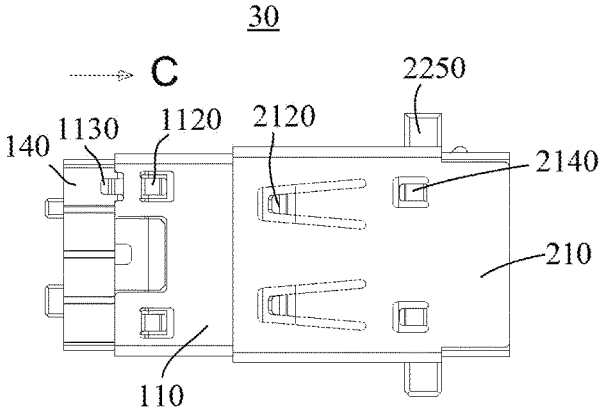
FIG. 17 is a top view of the connector assembly in FIG. 15.
Figure 18:
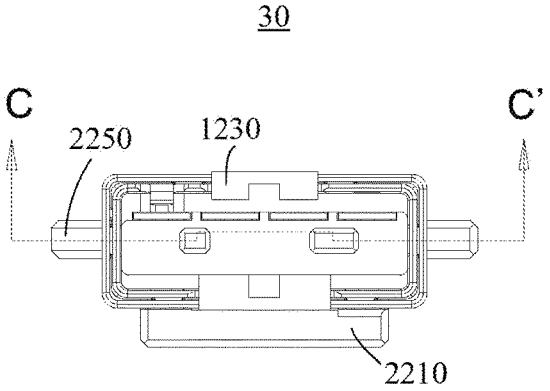
FIG. 18 is a side view viewed along direction C of FIG. 17.
Figure 19:
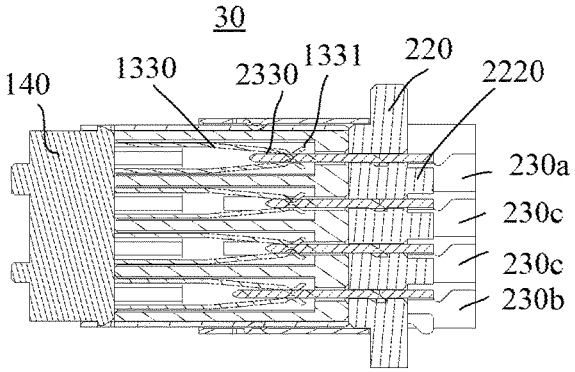
FIG. 19 is a cross-sectional view taken along line C-C' of FIG. 18.

A description is provided with reference to FIG. 17 to FIG. 19. FIG. 17 is a top view of the connector assembly in FIG. 15. FIG. 18 is a side view viewed along direction C of FIG. 17. FIG. 19 is a cross-sectional view taken along line C-C' of FIG. 18. In the state where the male plug 10 and the female socket 20 are connected, a resisting force is generated between the housing 210 of the female socket 20 and the first housing 110 of the male plug 10, so that the terminal portions of the female socket 20 and the elastic pieces of the terminals of the male plug are connected at appropriate positions. The terminal contact portions 2330 of the terminal portions 230 of the female socket 20 pass through the connection slots 1210 of the male plug 10 and are inserted and held in the elastic pieces 1331 of the signal contact portions 1330 of the male plug 10 to connect the power terminal, the signal terminals, and the ground terminal corresponding to the terminal portions 230 of the female socket 20. The power signal, data signals, and ground signal corresponding to the terminal portions 230 are transmitted to the terminals 130 of the male plug 10.

Figure 20:
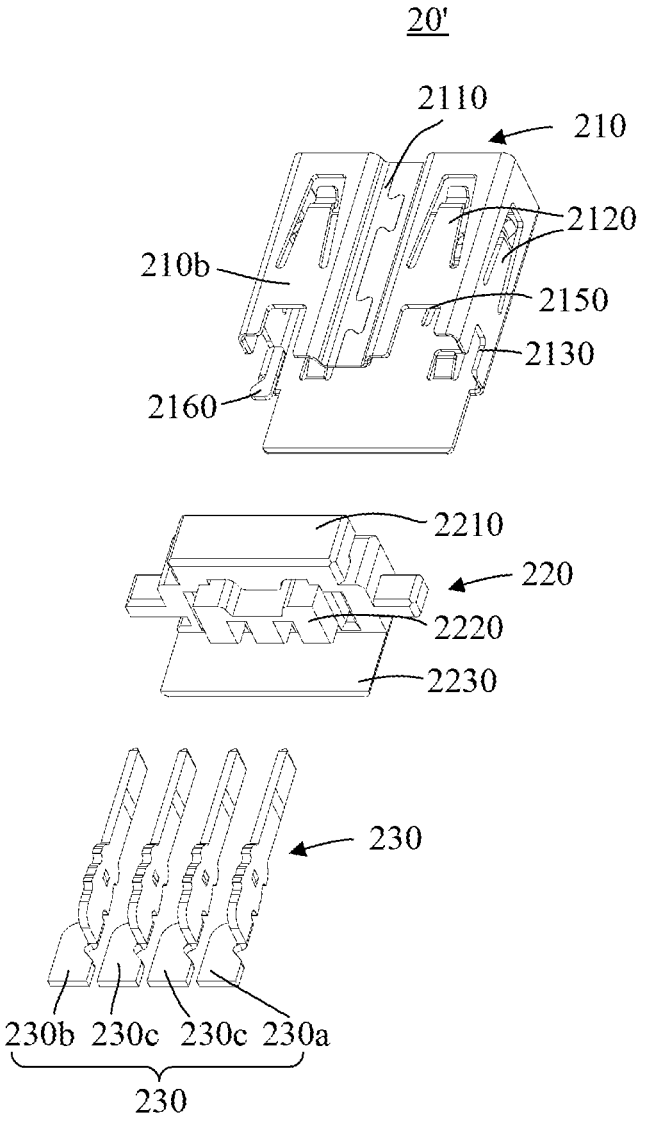
FIG. 20 illustrates an exploded view of a female socket according to another embodiment of the present disclosure.
Figure 21:
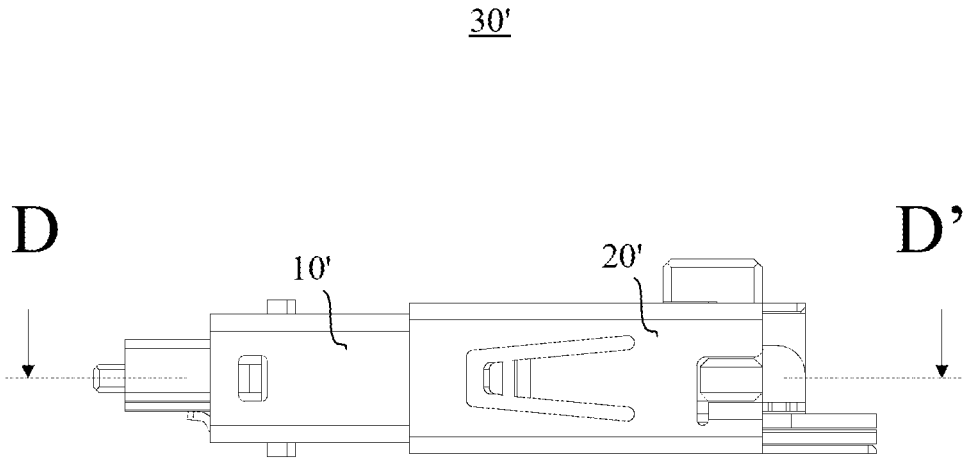
FIG. 21 illustrates a side view of a connector according to another embodiment of the present disclosure.
Figure 22:
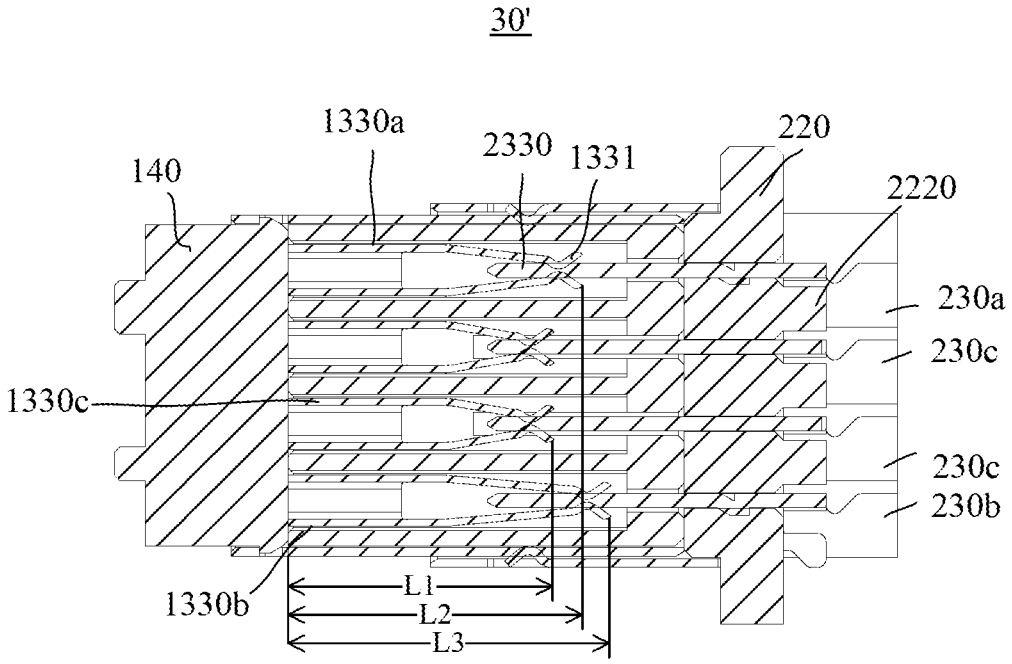
FIG. 22 illustrates a cross-sectional view taken along line D-D' of FIG. 21.

Please refers to FIG. 20 to FIG. 22. FIG. 20 illustrates an exploded view of a female socket 20' according to another embodiment of the present disclosure. FIG. 21 illustrates a side view of a connector 30' according to another embodiment of the present disclosure. FIG. 22 illustrates a cross-sectional view taken along line D-D' of FIG. 21. The embodiment shown in FIGS. 20-22 includes the same elements shown in FIGS. 8-19. The terminal contact portions 2330 of the terminal portions 230 of the female socket 20' pass through the connection slots 1210 of the male plug 10' and are inserted and held in the signal contact portions 1330*a*, 1330*b*, 1330*c* of the male plug 10'. When the power terminal portion 230*a*, the ground terminal portion 230*b*, and the signal terminal portions 230*c* are respectively connected to the power terminal 130*a*, the ground terminal 130*b*, and the signal terminals 130*c*, they can be respectively used for transmitting the power signal, the ground signal, and the data signals. Differing from the embodiment illustrated in FIGS. 8-19, a length of the ground terminal portion 230*b*, a length of the power terminal portion 230*a*, and a length of the signal terminal portions 230*c* are identical, while a length L3 of the signal contact portion 1330*b* is greater than a length L2 of the signal contact portion 1330*a*, and the length L2 of the signal contact portion 1330*a* is greater than a length L1 of the signal contact portion 1330*c*.

According to the present disclosure, the structure of the elastic pieces of the male plug and the female socket and the connector assembly are improved. Through using a pair of elastic pieces to hold and therefore connect two sides of the terminal portions, a better elastic performance and fixing effect can be obtained, thus extending service life and providing a connection sequence based on the lengths of the terminal portions. The elastic piece has an outwardly expanding interface at one end close to the connection port to effectively ensure the plugging and unplugging between the male plug and female socket and the plugging reliability. In addition, a resisting force is generated between the insulation housing of the female socket and the insulation housing of the male plug, so that the terminal portions of the female socket and the elastic pieces of the terminals of the male plug are connected at appropriate positions to prevent the elastic pieces from exerting excessive stress or being pressed too much to cause breakage or elastic fatigue. The present disclosure improves the signal transmission quality and stability of the connector, thereby increasing the appeal of the product to consumers.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A male plug of a connector, the male plug being assembled to a female socket, the male plug comprising:

a plurality of terminals, each of the terminals comprising a signal contact portion, a U-shaped terminal fixing portion, and a terminal soldering portion, the signal contact portion extending from two opposite sides of the terminal fixing portion, being configured to hold a terminal portion of the female socket correspondingly when the male plug is inserted into the female socket, the U-shaped terminal fixing portion of each of the terminals connecting the signal contact portion and the terminal soldering portion; and a first insulation body having a plurality of connection slots each of the connection slots being configured to receive the terminal correspondingly;

wherein the plurality of terminals comprise a ground terminal, a power terminal, and a signal terminal, the ground terminal is configured to transmit a ground voltage, the power terminal is configured to transmit a power voltage, the signal terminal is configured to transmit a data signal;

wherein the male plug further comprises a first housing, the first housing encapsulates the first insulation body, the first housing comprises a fitting portion configured to receive a protrusion portion of the female socket correspondingly when the male plug is assembled to the female socket.

2. The male plug as claimed in claim 1, wherein the signal contact portion is a pair of elastic pieces.

3. A connector system comprises:

a female socket of a connector, the female socket being assembled to a male plug, the male plug comprising:

a plurality of terminals, each of the terminals comprising a signal contact portion, a U-shaped terminal fixing portion, and a terminal soldering portion, the signal contact portion extending from two opposite sides of the terminal fixing portion, being configured to hold a terminal portion of the female socket correspondingly when the male plug is inserted into the female socket, the U-shaped terminal fixing portion of each of the terminals connecting the signal contact portion and the terminal soldering portion; and a first insulation body having a plurality of connection slots each of the connection slots being configured to receive the terminal correspondingly;

the female socket comprising:

a plurality of terminal portions configured to be held by signal contact portions extending from two opposite sides of a terminal fixing portion of the male plug when the female socket is assembled to the male plug, lengths of the plurality of terminal portions being different; and a second insulation body having a plurality of receiving slots, each of the receiving slots being configured to receive the terminal portion correspondingly;

wherein the female socket further comprises a second housing, the second housing is engaged with the second insulation body, the second housing comprises a protrusion portion configured to be engaged with a fitting portion of the male plug when the male plug is assembled to the female socket;

wherein the plurality of terminals comprise a ground terminal, a power terminal, and a signal terminal, the ground terminal is configured to transmit a ground voltage, the power terminal is configured to transmit a power voltage, the signal terminal is configured to transmit a data signal;

wherein the male plug further comprises a first housing, the first housing encapsulates the first insulation body, the first housing comprises a fitting portion configured to receive a protrusion portion of the female socket correspondingly when the male plug is assembled to the female socket.

4. The connector system as claimed in claim 3, wherein the female socket comprises the plurality of terminal portions comprise a ground terminal portion, a power terminal portion, and a signal terminal portion, the ground terminal portion is configured to transmit a ground voltage, the power terminal portion is configured to transmit a power voltage, the signal terminal portion is configured to transmit a data signal.

5. The connector system as claimed in claim 4, wherein the female socket comprises a length of the ground terminal portion is greater than a length of the power terminal portion, the length of the power terminal portion is greater than a length of the signal terminal portion.

6. A connector, comprising:

a male plug comprising:

a plurality of terminals, each of the terminals comprising a signal contact portion, a U-shaped terminal fixing portion, and a terminal soldering portion, the U-shaped terminal fixing portion of each of the terminals connecting the signal contact portion and the terminal soldering portion; and a first insulation body having a plurality of connection slots, each of the connection slots being configured to receive the terminal correspondingly; and a female socket comprising:

a plurality of terminal portions; and a second insulation body having a plurality of receiving slots, each of the receiving slots being configured to receive the terminal portion correspondingly;

wherein when the male plug is plugged into the female socket, the plurality of terminal portions are held by the signal contact portions of the male plug;

wherein the plurality of terminals comprise a ground terminal, a power terminal, and a signal terminal, the plurality of terminal portions comprise a ground terminal portion, a power terminal portion, and a signal terminal portion, the ground terminal portion and the ground terminal are configured to transmit a ground voltage, the power terminal portion and the power terminal are configured to transmit a power voltage, the signal terminal portion and the signal terminal are configured to transmit a data signal;

wherein a length of the ground terminal portion is greater than a length of the power terminal portion, the length of the power terminal portion is greater than a length of the signal terminal portion.

7. The connector as claimed in claim 6, wherein the male plug further comprises a first housing, the first housing encapsulates the first insulation body, the first housing comprises a fitting portion, the female socket further comprises a second housing, the second housing is engaged with the second insulation body, the second housing comprises a protrusion portion configured to be engaged with the fitting portion of the male plug when the male plug is assembled to the female socket.

8. The connector as claimed in claim 6, wherein the terminal portion comprises a terminal contact portion, a terminal fixing portion, and a terminal contour portion, an angle is formed between the terminal soldering portion and the terminal contact portion, the angle is from 80 to 90 degrees.

9. The connector as claimed in claim 6, wherein a length of the signal contact portion contacting the ground terminal portion is greater than a length of the signal contact portion contacting the power terminal portion, and the length of the signal contact portion contacting the power terminal portion is greater than a length of the signal contact portion contacting the signal terminal portion.

* * * * *